United States Patent [19]

Yamamoto

[11] 4,209,172

[45] Jun. 24, 1980

[54] GOLF BALL PUTTER CLUB AND PUTTING METHOD

[76] Inventor: Jiro Yamamoto, 2954 Palos Verdes Dr., North, Rolling Hills, Calif. 90274

[21] Appl. No.: 867,785

[22] Filed: Jan. 9, 1978

[51] Int. Cl.[2] ..... A63B 69/36

[52] U.S. Cl. ..... 273/183 C; 273/183 D; 273/164; 273/169

[58] Field of Search ..... 273/183 D, 199 R, 213, 273/186 C, 183 C, 186 B, 62, 169, 162 R, 163 R, 163 A, 164; 40/327

[56] References Cited

U.S. PATENT DOCUMENTS

| | | | |
|---|---|---|---|
| 676,506 | 6/1901 | Knight et al. | 40/327 X |
| 2,709,595 | 5/1955 | DeVries | 273/199 R X |
| 3,753,565 | 8/1973 | Baker | 40/327 X |
| 3,880,430 | 4/1975 | McCabe | 273/183 D |

FOREIGN PATENT DOCUMENTS

| | | | |
|---|---|---|---|
| 904785 | 8/1962 | United Kingdom | 273/183 C |

*Primary Examiner*—George J. Marlo
*Attorney, Agent, or Firm*—Don B. Finkelstein

[57] ABSTRACT

A golf ball and putting club each of which includes alignment lines to facilitate putting the ball. The lines on the golf ball are located at a right angle to each other and are equatorial markings. The lines on the upper surface of the putter head includes a first line perpendicular to the putting face, and a second line perpendicular to and centered about the first line. The length of the second line on the club corresponds to the diameter of the golf ball. In use, the first line on the club is aligned in the same plane as one equatorial marking on the ball, and the second line on the club head is aligned parallel to the second equatorial marking on the ball.

13 Claims, 10 Drawing Figures

GOLF BALL PUTTER CLUB AND PUTTING METHOD

BACKGROUND OF THE INVENTION

1. Field of the Invention

This invention relates to the golf art and more particularly to an improved putter and golf ball arrangement useful in aligning and executing a putt in the game of golf with greater accuracy.

Throughout the history of the game of golf, players have had difficulty properly aligning a putter club head with a golf ball along an intended direction of ball travel and accurately stroking the putter club head through the ball along that direction. The ball striking surface must be perpendicular to the direction of club head travel and the club head must be moved along the precise direction line of the putt to avoid hitting the ball off-line or imparting an undesired spin to the ball. Proper putting alignment and stroke are two of the most difficult aspects of the game, while accurate putting is probably the most important requiste for a good golf score.

2. Description of the Prior Art

There have heretofore been proposed several types of markings to be placed on a golf club putter to aid in the proper alignment of the putter by a player in preparation for striking the golf ball for movement in the desired direction. Such markings have been proposed in a wide variety of forms. Probably the most common marking is a line on the upper surface of the putter club head in the direction perpendicular to the ball striking surface, and extending rearwardly therefrom. Alignment of such a marking along the intended direction of travel of the golf ball thus orients the club striking surface perpendicular to that direction of travel. Theoretically, this aids proper initial alignment of the putter club head relative to the ball and the target. However, in practice such alignment is difficult to obtain relative to an unmarked golf ball and a target cup many feet away. When a player addresses a golf ball on a putting green, he must first align the club with the ball and then rotate his head to assure that the putter is indeed also aligned with the cup. This process often requires alterations of the initial position of the putter club head after checking the alignment with the target cup. Further, the alignment finally accepted by many players is poor due to an inability to accurately perceive the true state of alignment from a position above the putter club head. It is also difficult to accurately stroke the putter club head through an unmarked golf ball such that the marking described above passes precisely along the intended direction of travel and through the point previously occupied by the center of the golf ball. A proper putt can be achieved only by such a stroke.

Marks have also been placed on the upper surface of the putter club head in a direction parallel to the ball striking surface in an attempt to facilitate initial alignment with a golf ball along an intended direction of travel. Such marks have also been incorporated in putters having lines perpendicular to the club striking surface as described above, thereby forming a "T" on the top surface of the club head. A further embellishment of this design includes separate markings at a lower point on the putter club head which are also visible from a point above the club head. Those marks are adapted to appear in a predetermined visual relationship with the marks on the top surface of the club head when a player's head is properly positioned directly above the putter club head. While useful to some extent, particularly in assuring that the player's head is properly positioned, they are of little help to a player in accurately aligning the putter club head with the ball along the intended direction of travel or in aiding him to properly stroke the putter through the ball. The initial alignment of the putter club head must still be achieved while addressing the ball with the putter club head in position and visually checking the alignment by turning ones head toward the cup and back again to the club head.

SUMMARY OF THE INVENTION

Accordingly, it is an object of the present invention to provide an improved putter and ball arrangement for use in the game of golf.

It is another object of the present invention to provide an improved putter and golf ball arrangement for more accurately aligning a putter club head with a golf ball in the intended direction of travel.

It is yet another object of the present invention to provide an improved putter and golf ball arrangment to facilitate proper movement of the golf club putter along the intended direction of travel of the golf ball and with its ball striking surface perpendicular to that direction.

It is yet another object of the present invention to provide an improved putter and golf ball arrangement to facilitate the aligning and striking of the golf ball at a predetermined desired point on a ball striking surface.

The above, and other objects of the present invention are achieved, according to a preferred embodiment thereof, by providing a golf club putter and a golf ball having corresponding alignment markings thereon. A golf club putter has a putter head member which includes a ball striking surface portion, a top surface portion extending rearwardly from the ball striking surface portion and a club alignment means on the top surface portion comprising a club marking having a leg extending from the ball striking surface portion in a direction perpendicular thereto. The golf ball has a ball alignment means thereon which comprises at least one equatorial ball alginment marking extending around the golf ball. The golf ball may therefore be positioned to provide said equatorial ball alignment marking lying within a plane perpendicular to the putting green beneath the golf ball and including the direction in which the golf ball is to be struck. The golf club putter may then be aligned with the golf ball to provide the leg of the club alignment means in said plane and appearing from above as a continuation of the equatorial ball alignment marking.

The combined putter and golf ball arrangement of this invention therefore facilitates proper initial alignment of a golf club putter with a golf ball relative to a target line by providing markings on the golf ball through which the golf ball itself is initially aligned with the target direction and a marking on the putter head member by which the putter head member can be rather easily aligned with the previously aligned golf ball, resulting in accurate putter head alignment with both the golf ball and the target direction. The otherwise difficult alignment step in putting is thus broken down into two relatively simple steps, enabling a more accurate and more easily obtained result. The conventional trial and error alignment procedure, which requires a high level of skill on the part of the player, is eliminated.

The proper stroking action of the putter head member through the ball along the intended line of travel is also made easier by those two markings. The two co-linear markings serve as a useful visual aid to the player in properly stroking the putter through that same line and in assuring that the ball is contacted squarely by the correct point on the ball striking surface.

The club alignment means may include a second club marking having a leg extending a distance equal to the diameter of a golf ball and perpendicular to and centered about the first club marking described above. This second club marking may be located adjacent the ball striking surface and is parallel thereto. A "T" is thus formed by the intersection of the first and second club markings. The second club marking enables the putter head member to be aligned with the golf ball to provide the second club marking perpendicular to the plane of the first equatorial ball alignment marking and directly opposite the golf ball while the first club marking is within that plane. This aids the player in initially aligning the putter head member with the golf ball such that the proper point on a ball striking surface is opposite the ball and also aids the player in properly stroking through the ball with that portion of the ball striking surface. The player striking the ball with the putter head member is able to visualize the passage of the second club marking through the space previously occupied by the ball.

The golf ball may be provided with a second equatorial ball alignment marking thereon which is located within a plane perpendicular to that occupied by the first ball alignment marking. This second equatorial ball alignment marking may be used with or without the second club marking described above. When the putter head member is initially aligned with the ball having both first and second equatorial ball alignment markings, the second equatorial ball alignment marking is positioned within a plane perpendicular to the surface of the putting green beneath the golf ball and including the direction in which the golf ball is to be struck. The putter head member is then aligned with its first club marking appearing from above as a continuation of the first equatorial ball alignment marking and with its vertical ball striking surface appearing as a line parallel to the second equatorial ball alignment marking. When a second club marking is used in conjunction with the second equatorial ball alignment marking, those markings appear from above as parallel lines of similar length which are directly opposite each other for the aligned condition of the putter head member and the golf ball. Proper initial alignment is indicated by a parallel relationship between the markings and their locations directly opposite each other. Both of these relationships are easily preceptible by the player addressing the ball, and are relatively easily maintained as the putter head member is stroked through the ball. The player need only maintain the initial co-linear relationship between the first equatorial ball alignment marking and the first club marking while at the same time maintaining the parallel and opposite relationships between the second equatorial ball alignment marking and the second club marking.

In the method of this invention, all alignment relative to the intended direction of ball travel is accomplished by a player prior to assuming the address position by aligning an equatorial marking on the ball with that direction. Simple visual alignment of the markings on the putter head member with those on the golf ball is the only alignment which must be achieved from the address position. No further visual references to the target cup need be made to execute an accurate putt. This point is of importance because the alignment of the ball itself with an intended direction of travel by sighting from a location behind the ball can be more easily accomplished than the conventional single step of aligning the ball and putter together along that direction from the address position. The second step of the instant invention then involves only a simple orientation of adjacent markings relative to each other to properly align the putter with the previously aligned ball.

Further, the markings of this invention provide a very real and noticeable aid in properly stroking the putter head member through the golf ball. The first club marking is merely maintained co-linear with the first equatorial ball alignment marking throughout the stroking process, and the second club marking is maintained parallel to and passed directly through the position initially occupied by the second equatorial ball alignment marking.

BRIEF DESCRIPTION OF THE DRAWINGS

The above and other objects of the present invention may be more fully understood from the following detailed description taken together with the accompanying drawings wherein similar reference characters refer to similar elements throughout and in which.

DESCRIPTION OF THE PREFERRED EMBODIMENTS

Figure 1:
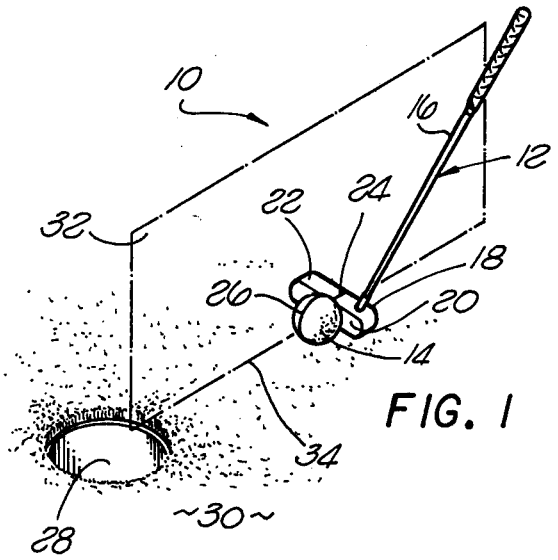
FIG. 1 is a perspective view of a putter and golf ball arrangement constructed in accordance with the teachings of the present invention in their aligned condition with an intended direction of ball travel.
Figure 2:
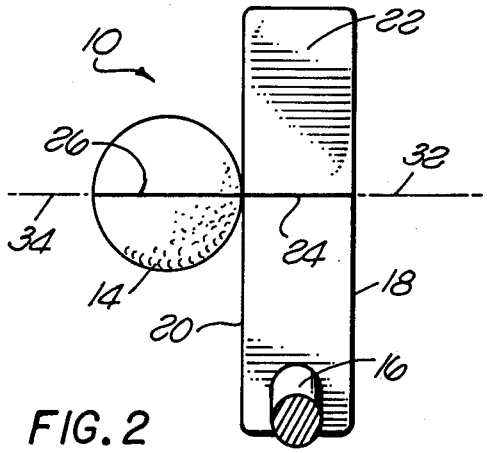
FIG. 2 is a top plan view of a putter head member and golf ball constructed in accordance with the teachings of the present invention and aligned relative to each other.
Figure 2A:
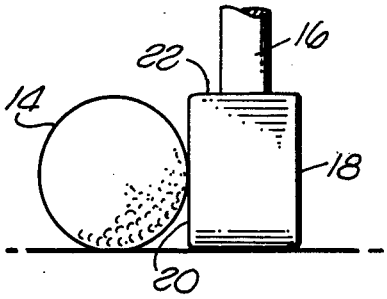
FIG. 2*a* is a side elevational view of the putter head member and golf ball of FIG. 2.

Referring now to FIGS. 1, 2 and 2*a*, there is illustrated one embodiment, generally designated 10, of the present invention. The embodiment 10 generally comprises a golf club 12 and a golf ball 14. The golf club 12 comprises a shaft arrangement 16 and a putter club head 18 having a ball striking surface portion 20 and an adjoining top surface portion 22 perpendicular thereto. The ball striking surface portion 20 and the top surface portion 22 are elongated in a direction which is parallel to the edge by which they are joined such that their length is several times their width, as is common in conventional golf club putters. The shaft arrangement 16 is joined to the putter club head 18 at a point on one end of the top surface portion 22. The top surface portion 22 is provided with a linear club marking 24 which extends across the narrow dimension of the top surface portion 22 in a direction perpendicular to the ball striking surface portion 20 at a point approximately midway between the ends of the top surface portion 22. The golf ball 14 is provided with a single equatorial ball alignment marking 26 extending thereabout.

FIG. 1 illustrates the embodiment 10 in an aligned condition relative to a target cup 28 on a putting green 30. The single equatorial ball alignment marking 26 of the golf ball 14 can be seen to be located within a plane 32 which is perpendicular to the surface of the putting green 30 directly beneath the golf ball 14 and includes a direction 34 along which the player intends to strike the golf ball 14. The putter club head 18 is positioned with the ball striking surface portion 20 directly adjacent the golf ball 14 on the side away from the cup 28. The bottom of the putter club head 18 is squarely rested or "soled" on the surface of the putting green 30 with the club marking 24 within the plane 32 and appearing from above as an extension of the equatorial ball alignment marking 26. This position comprises the aligned condition of the embodiment 10 with the ball striking surface portion 20 perpendicular to the direction 34 along which the player intends to strike the ball and properly centered relative to the ball.

Figure 7:
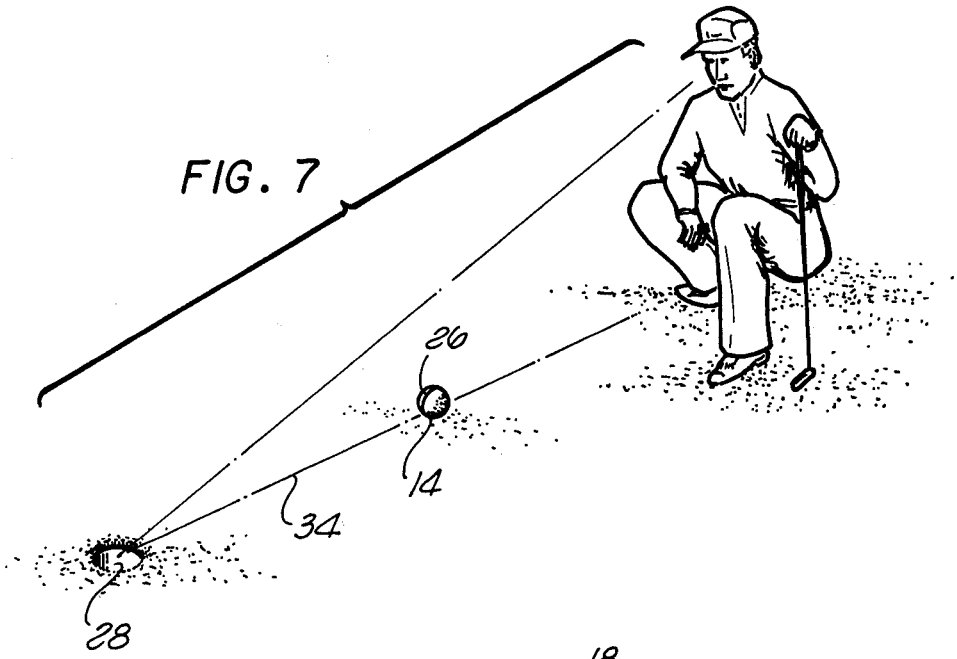
FIG. 7 is a perspective view of a golf ball constructed in accordance with the present invention in the process of being visually aligned relative to the intended direction of travel toward a target cup.
Figure 8:
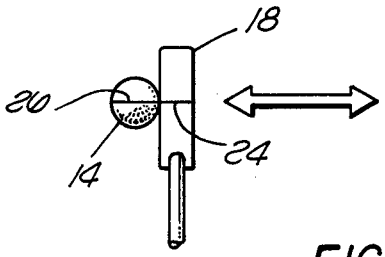
FIG. 8 is a top plan view of the golf club putter and golf ball constructed in accordance with the present invention as seen by a player addressing the ball in preparation for attempting a putt.

In operation, the alignment of a putt using the arrangement of the present invention involves two basic steps. Those steps are illustrated graphically in FIGS. 7 and 8, respectively. When a player strikes his ball onto the green, he is allowed under the rules of golf to remove his ball from the putting surface and to replace the ball with another if desired. The player may at this time align the marking 26 of the ball 14 with the intended direction of travel 34, or may replace the conventional ball which he has been using with a ball marked according to the teachings of the instant invention. The desired ball alignment can be accomplished while the player is behind the location of the golf ball 14 and can see both the golf ball 14 and the target cup 28. A particular condition of alignment of the ball 14 can be checked by sighting from a point behind the golf ball 14 to see that the ball alignment marking 26 is directed along the intended direction of travel 34. A condition of misalignment can be readily corrected and rechecked from this position. The player then assumes his putting stance and addresses the ball with the putter club head 18 squarely soled on the surface of the putting green 30 directly behind the golf ball 14 such that the linear club marking 24 is within the plane 32 which includes the equatorial ball alignment marking 26. In this fully aligned condition, the linear club marking 24 appears to the player from his position above the ball to be co-linear with the equatorial ball alignment marking 26 and an extension thereof. It is this apparent relationship between the markings 24 and 26 which signifies to the player that his putter is properly aligned. Any misalignment can therefore be easily and accurately checked and corrected from the address position without the necessity of referring to the location of the target cup 28. A difficult problem of perception inherent in putting as heretofore practiced is therefore eliminated. A player utilizing the instant invention therefore need not align his ball entirely from the address position, but rather may accomplish all alignment relative to the attendant direction of travel from a position behind the ball 14 and then align the putter club head 18 with the golf ball 14 from the address position by merely matching two lines. The proper putting stroke of the putter club head 18 through the golf ball 14 is further facilitated by the visual aid of the aligned markings 24 and 26. The intended direction of travel is visually represented by those lines and the player need only maintain the linear club marking 24 along that line during his putting stroke to strike the ball accurately along the desired direction.

Figure 3:
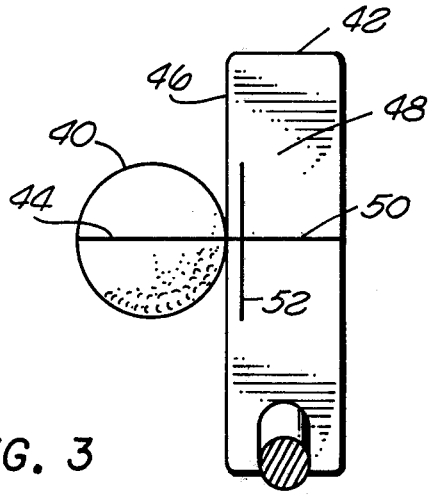
FIG. 3 is a top plan of a second embodiment of a putter head member and golf ball constructed in accordance with the present invention and aligned relative to each other.
Figure 4:
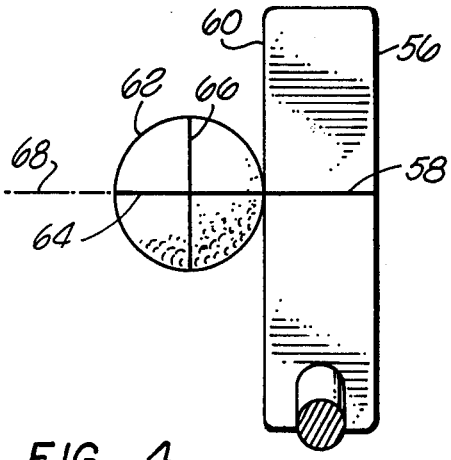
FIG. 4 is a top plan view of a third embodiment of a putter head member and a golf ball constructed in accordance with the present invention and aligned relative to each other.
Figure 5:
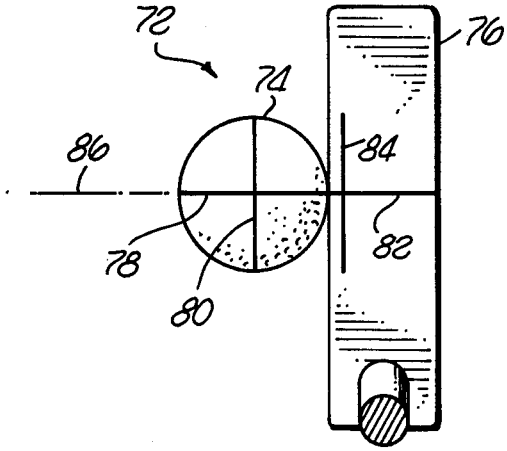
FIG. 5 is a top plan view of a fourth embodiment of a putter head member and a golf ball constructed in accordance with the present invention and aligned relative to each other.
Figure 6:
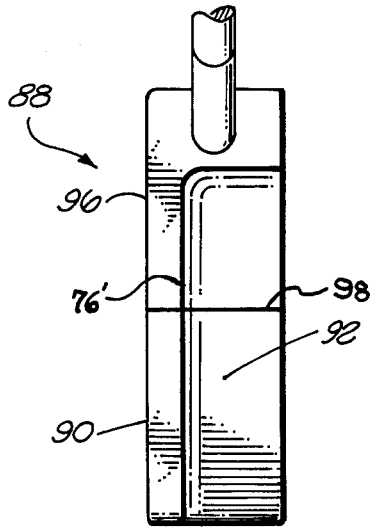
FIG. 6 is a top plan view of a fifth embodiment of the putter head member of the instant invention.
Figure 6A:
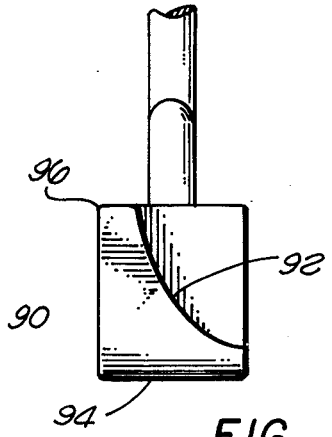
FIG. 6*a* is a side elevational view of the putter head member of FIG. 6.

The embodiments shown in FIGS. 3, 4, and 5 incorporate all of the structure and markings described above in relation to the embodiment of FIGS. 1 and 2, and include one or more additional markings as described above. The embodiment of FIG. 3 consists essentially of a golf ball 40 and a putter club head 42. The golf ball 40 has a single equatorial ball alignment marking 44 which is identical to the marking 26 of FIG. 2, and is in all other ways similar to the golf ball 14. The putter club head 42 has a ball striking surface portion 46 and a top surface portion 48. The top surface portion 48 has a first linear club alignment marking 50 which is similar to the club marking 24 of FIG. 2, and a second linear club alignment marking 52 which extends symmetrically about the first linear club alignment marking 50 and perpendicular thereto a distance equal to the diameter of a golf ball. The second linear club alignment marking 52 is adjacent the ball striking surface 46 and parallel thereto. The putter club head 42 and the golf ball 40 are properly aligned relative to each other when the linear club marking 50 appears from above to be co-linear with and an extension of the single equatorial ball alignment marking 44, as described above in relation to the marks 24 and 26 of FIG. 2. In this condition, the second linear club marking 52 is positioned directly opposite the golf ball 40. This aids both in initial alignment of the putter club head 42 with the golf ball 40 and with the putting stroke itself as the golf ball 40 is struck. In stroking the putter club head 42, the player can visualize the second linear club marking 52 moving directly through the space previously occupied by the golf ball 40, and can thereby attain a smoother and more accurate stroke. In all other respects, the structure and use of the embodiment of FIG. 3 is identical to that of FIG. 2.

The embodiment shown in FIG. 4 utilizes a putter club head 56 which is identical to the putter club head 18 described in relation to the embodiment of FIG. 2. It therefore has a linear club marking 58 which is similar to the club marking 24. The linear club marking 58 is perpendicular to a ball striking surface 60. A golf ball 62 is provided with equatorial ball alignment markings 64 and 66 which are located in perpendicular planes. The golf ball 62 is aligned relative to an intended direction of travel 68 by orienting the golf ball 62 such that the planes of the ball alignment markings 64 and 66 are perpendicular to the surface of the putting green beneath the ball, and the plane of the ball alignment marking 64 includes the intended direction of travel 68. The plane of the ball alignment marking 66 is therefore perpendicular to that direction. The putter club head 56 is aligned relative to the golf ball 62 at the address position by placing the linear club marking 58 within the plane of the ball alignment marking 64 and the ball striking surface 60 parallel to the ball alignment marking 66. The alignment of the ball 62 with the intended direction of travel 68 is accomplished in the same way as described above in reference to the embodiment of FIGS. 2 and 3, using the ball alignment marking 64. The alignment of the putter club head 56 with the golf ball 62 by a player at the address position is accomplished by causing the linear club marking 58 to appear as an extension of the ball alignment marking 64 and the upper edge of the ball striking surface 60 to appear parallel to the ball alignment marking 66. These co-linear and parallel relationships are easily perceptible by the player from above the ball, and are relatively easily maintained as the putter club head 56 is moved to strike the golf ball 62.

The embodiment 72 of FIG. 5 comprises a golf ball 74 which is identical to the golf ball 62 of FIG. 4 and a putter club head 76 which is identical to the putter club head 42 of FIG. 3. The golf ball 74 is therefore provided with equatorial ball alignment markings 78 and 80 which are located within perpendicular planes. The putter club head 76 is provided with a first linear club marking 82 which is identical to the marking 50 of FIG. 3, and a second linear club marking 84 which is identical to the marking 52 of FIG. 3.

In operation, the golf ball 74 is aligned with the planes of the equatorial ball alignment markings 78 and 80 perpendicular to the surface of the putting green beneath the ball, with the plane of the equatorial ball alignment marking 78 containing an intended direction of travel 86. This is accomplished by sighting from a point behind the golf ball 74 generally along the intended direction of travel 86. The putter club head 76 is then moved adjacent the ball 74 and oriented such that the first linear club marking 82 is also within the plane of the equatorial ball alignment marking 78 and the second linear club marking 84 is parallel to the plane of the equatorial ball alignment marking 80. This is done by moving the putter club head 76 to the point where the first linear club marking 82 appears co-linear with and as an extension of the equatorial ball alignment marking 78 and the second linear club marking 84 appears parallel with and directly opposite the equatorial ball alignment marking 80. In this condition, the golf ball 74 is located adjacent the point of the putter club head 76 with which it is to be struck and the ball striking surface of the putter club head 76 is precisely perpendicular to the intended direction of ball travel. This embodiment is especially well adapted to alignment of the putter club head 76 relative to the golf ball 74 by a player whose head is above the ball. Aside from aligning the marking 82 to appear as an extension of the marking 78 the putter is further assisted visually by the markings 84 and 80. In the condition of proper alignment, the markings 84 and 80 will appear from above to be parallel lines of exactly equal length which are opposite each other. The putting stroke is also visually aided not only by the linear alignment of the markings 82 and 78, but also the effect by which the marking 84 appears to pass through the area previously occupied by the marking 80 which the golf ball 74 is struck.

A still further embodiment 88 of the putter head member of the instant invention comprises generally a ball striking surface portion 90, a top surface portion 92 and a bottom surface portion 94. The ball striking surface portion 90 joins the top surface 92 along an upper edge 96 which is parallel to the bottom surface portion 94. The top surface portion 92 is convex and extends rearward and downward from the upper edge 76' to a point adjacent the bottom surface portion 90 at the rearmost portion of the putter head member 88. A club marking 98 on the top surface portion 92 extends rearward and downward from the upper edge 96 of the ball striking surface portion 90 within a plane which is perpendicular to both the ball striking surface portion 90 and the bottom surface portion 94. The club marking 98, while actually nonlinear, appears from above to be linear and perpendicular to the ball striking surface 90. A second ball marking parallel to the ball striking surface portion 90 can also be added to the putter head member 88, as taught above relative to the embodiments of FIGS. 3 and 5. The variant top surface structure of the putter head member 88 may therefore be incorporated into any of the embodiments of the present invention without a loss of function. The club marking 98 will appear from above as identical to the club markings 24, 50, 58 and 82 discussed above, and may be similarly aligned with an equatorial marking on a golf ball to aid in aligning and stroking the putter.

From the above, it can be seen that there has been provided a new and improved golf club putter and golf ball arrangement for more accurately aligning and executing putts in the game of golf. The novel arrangement includes at least one equatorial ball alignment marking and at least one corresponding marking on the putter club head to be aligned therewith. The golf ball may be aligned relative to the intended direction of travel from a position other than the address position. This enable the marking on the ball to be accurately aligned with the intended direction of travel, and that alignment to be checked from a point behind the golf ball by citing along that marking. The putter club head can then be aligned relative to the golf ball, and therefore relative to the intended direction of travel, by simply visually matching markings on the putter club head with those on the ball. The markings on the putter club head and ball in addition act as visual aids to the player in executing the putt itself.

Those skilled in the art may find many variations and adaptations of the present invention and the appended claims are intended to cover all such variations and adaptations falling within the true scope and spirit of the invention.

I claim:

1. An improved combined putter and golf ball arrangement comprising, in combination:

a golf club putter means having a putter head member and said putter head member having:

a ball striking surface portion extending a distance substantially greater than the diameter of a golf ball;

a top surface portion extending rearwardly from said ball striking surface portion;

club alignment means on said top surface portion comprising a first club marking having a leg extending from said ball striking surface portion in a direction which appears from above to be perpendicular thereto, and a second club marking extending a distance equal to the diameter of a golf ball and perpendicular to and centered about said first club marking; and a golf ball means having a ball alignment means thereon comprising at least one ball alignment marking, and said at least one ball alignment marking comprising a first equatorial ball alignment marking extending around said golf ball means;

whereby said golf ball means may be positioned to provide said first equatorial ball alignment marking lying within a first plane perpendicular to the surface of a putting green beneath said golf ball means and including the direction in which said golf ball means is to be struck, and said golf club putter means may be aligned with said golf ball means to provide said leg of said club alignment means in said first plane and appearing from above as a continuation of said first equatorial ball alignment marking and said second club marking appearing parallel to and substantially equal in extent to the diametric extent of said golf ball, as viewed from above.

2. The arrangement defined in claim 1 wherein said top surface portion of said putter head member has a first section adjacent said ball striking face, and a second section extending rearwardly from said first section and in a plane other than the plane containing said first section, and said first club marking extends on said first section and said second section.

3. The arrangement defined in claim 13 wherein said second section is curvilinear.

4. An improved combined putter and golf ball arrangement comprising, in combination:

a golf club putter means having a putter head member and said putter head member having:

a ball striking surface portion extending a distance substantially greater than the diameter of a golf ball; a top surface portion extending rearwardly from said ball striking surface portion;

club alignment means on said top surface portion comprising a first club marking extending from said ball striking surface portion in a direction which appears from above as perpendicular thereto, and a second marking adjacent and parallel to said ball striking surface portion and extending a distance equal to the diameter of a golf ball perpendicular to and centered about said first marking; and a golf ball means having a ball alignment means comprising at least one ball alignment marking, and said at least one ball alignment marking comprising a first equatorial ball alignment marking extending around said golf ball means;

whereby said golf ball means may be positioned to provide said first equatorial ball alignment marking lying within a first plane perpendicular to the surface of the putting green beneath said golf ball means and including the direction in which said golf ball means is to be struck, and said golf club putter means may be aligned with said golf ball means to provide said first club marking in said first plane and appearing from above as a continuation of said first equatorial ball alignment marking and said second club marking perpendicular to said first plane and directly opposite said golf ball means and said second club marking appearing parallel to and substantially equal in extent to the diametric extent of said golf ball, as viewed from above.

5. The arrangement defined in claim 3 wherein said top surface portion of said putter head member has a first section adjacent said ball striking face, and a second section extending rearwardly from said first section and in a plane other than the plane containing said first section, and said first club marking extends on said first section and said second section.

6. The arrangement defined in claim 3 wherein said second section is curvilinear.

7. An improved combined putter and golf ball arrangement comprising, in combination:

a golf club putter means having a putter head member and said putter head member having:

a ball striking surface portion extending a distance substantially greater than the diameter of a golf ball;

a top surface portion extending rearwardly from said ball striking surface portion;

club alignment means on said top surface portion comprising a club marking having a leg extending from said ball striking surface portion in a direction which appears from above as perpendicular thereto, and a second club marking extending a distance equal to the diameter of a golf ball and perpendicular to and centered about said first club marking; and a golf ball means having a ball alignment means thereon comprising first and second equatorial ball alignment markings extending around said golf ball means in perpendicular planes;

whereby said golf ball means may be positioned to provide said first equatorial ball alignment marking lying within a first plane perpendicular to the surface of a putting green beneath said golf ball means and including the direction in which said golf ball means is to be struck and said second equatorial ball alignment marking lying within a second plane perpendicular to the surface of the putting green beneath said golf ball means to said first plane, and said golf club putter means may be aligned with said golf ball means to provide said leg of said club alignment means in said first plane and appearing from above as a continuation of said first equatorial ball alignment marking and said ball striking surface portion parallel to said second plane and said second club marking appearing parallel to and substantially equal in extent to the diametric extent of said golf ball, as viewed from above.

8. The arrangement defined in claim 4 wherein said top surface portion of said putter head member has a first section adjacent said ball striking face, and a second section extending rearwardly from said first section and in a plane other than the plane containing said first section, and said first club marking extends on said first section and said section section.

9. The arrangement defined in claim 4 wherein said second section is curvilinear.

10. An improved combined putter and golf ball arrangement comprising, in combination:

a golf club putter means having a putter head member and said putter head member having:

a ball striking surface portion;

a top surface portion extending rearwardly from said ball striking surface portion;

club alignment means on said top surface portion comprising a first club marking having a leg extending from said ball striking surface portion in a direction which appears from above as perpendicular thereto, and a second club marking adjacent and parallel to said ball striking surface portion and extending a distance equal to the diameter of a golf ball perpendicular to and centered about said first marking; and a golf ball means having a ball alignment means thereon comprising first and second equatorial ball alignment markings extending around said golf ball means in perpendicular planes;

whereby said golf ball means may be positioned to provide said first equatorial ball alignment marking lying within a first plane perpendicular to the surface of a putting green beneath said golf ball means and including the direction in which said golf ball means is to be struck and said second equatorial ball alignment marking lying within a second plane perpendicular to the surface of the putting green beneath said golf ball means and to said first plane, and said golf club putter means may be aligned with said golf ball means to provide said first club marking in said first plane and appearing from above as a continuation of said first equatorial ball alignment marking and said second club marking parallel to said second plane and appearing from above as directly opposite said second equatorial ball alignment marking, and said second club marking appearing parallel to and substantially equal to the extent of said second equatorial ball alignment marking as viewed from above.

11. The arrangement defined in claim 10 wherein said top surface portion of said putter head member has a first section adjacent said ball striking face, and a second section extending rearwardly from said first section and in a plane other than the plane containing said first section, and said first club marking extends on said first section and said second section.

12. The arrangement defined in claim 10 wherein said second section is curvilinear.

13. A method of aligning and executing a putt in the game of golf which comprises the steps of:

positioning a golf ball means having a ball alignment means thereon comprising first and second equatorial ball alignment markings extending around said golf ball means in perpendicular planes such that said first equatorial ball alignment marking lies within a first plane perpendicular to the surface of a putting green beneath said golf ball means and including a predetermined direction in which it is desired to strike said golf ball means, and said second equatorial ball alignment marking lies within a second plane perpendicular to the surface of the putting green beneath said golf ball means and to said first plane;

positioning a golf club putter means having club alignment marking thereon comprising a first club alignment marking extending away from and appearing from above as perpendicular to a ball striking surface of said golf club putter means on an upward facing surface of said golf club putter means, and a second club alignment marking on said upward facing surface of said golf club putter means, said second club alignment marking extending a distance equal to the diameter of a golf ball and perpendicular to and centered about said first club alignment marking; and positioning said golf club putter means relative to said first and second equatorial ball alignment markings comprising the further steps of:

aligning said first club alignment marking within said first plane such that said first club alignment marking appears from above as a continuation of said first equatorial ball alignment marking; and simultaneously aligning said ball striking surface such that the upper edge of said ball striking surface appears from above as parallel to said second equatorial ball alignment marking; and aligning said second club alignment marking parallel to and directly opposite said second equatorial ball alignment marking; and striking said golf ball means with said golf club putter means along the direction of said first equatorial ball alignment marking as viewed from above.

* * * * *